US005248240A

United States Patent [19]

Correia

[11] Patent Number: 5,248,240

[45] Date of Patent: Sep. 28, 1993

[54] TURBINE STATOR VANE ASSEMBLY

[75] Inventor: Victor H. S. Correia, Cincinnati, Ohio

[73] Assignee: General Electric Company, Cincinnati, Ohio

[21] Appl. No.: 14,908

[22] Filed: Feb. 8, 1993

[51] Int. Cl.[5] ..... F01D 5/22

[52] U.S. Cl. ..... 415/209.1; 415/191

[58] Field of Search ..... 415/191, 200, 208.1, 415/209.1, 915; 29/889.2, 889.21

[56] References Cited

U.S. PATENT DOCUMENTS

| | | | |
|---|---|---|---|
| 2,982,519 | 5/1961 | Haworth et al. | 415/209.1 |
| 3,952,391 | 4/1976 | Gee | 29/889.2 |
| 4,470,754 | 9/1984 | Manente, Jr. et al. | 415/136 |
| 4,477,222 | 10/1984 | Wolf | 415/138 |
| 4,511,306 | 4/1985 | Hultgren | 415/136 |
| 4,621,976 | 11/1986 | Marshall et al. | 415/191 |
| 4,737,417 | 4/1988 | Mushardt et al. | 29/889.2 |
| 4,812,107 | 3/1989 | Barcella et al. | 29/889.21 |
| 5,001,830 | 3/1991 | Partington et al. | 29/889.21 |
| 5,174,715 | 12/1992 | Martin | 415/209.4 |
| 5,176,496 | 1/1993 | Correza et al. | 415/209.2 |

*Primary Examiner*—John T. Kwon

*Attorney, Agent, or Firm*—Jerome C. Squillaro; Carmen Santa Maria

[57] ABSTRACT

A three-piece stator vane assembly for use in gas turbine engines. The stator vane assembly is constructed so as to more readily withstand the mechanical stresses imposed during engine operation, as well as to reduce the tendency for the cast components of the stator vane assembly to recrystallize during the casting process, thus preserving the metallurgical integrity of the stator vane assembly. As a result, the stator vane assembly is better able to structurally withstand the severe operating conditions within the turbine section of a gas turbine engine.

18 Claims, 2 Drawing Sheets

TURBINE STATOR VANE ASSEMBLY

The present invention relates to stator vanes used to direct airflow between stages within the turbine nozzle of a gas turbine engine. More particularly, this invention relates to a stator vane assembly which is better able to resist mechanical stresses imposed during engine operation, as well as reduce the occurrence of certain cast-in stresses which are created during the casting of the stator vane assembly, such that the metallurgical integrity of the stator vane assembly is preserved.

BACKGROUND OF THE INVENTION

Conventional gas turbine engines generally operate on the principle of compressing air within a compressor section of the engine, and then delivering the compressed air to the combustion section of the engine where fuel is added to the air and ignited. Afterwards, the resulting combustion mixture is delivered to the turbine section of the engine, where a portion of the energy generated by the combustion process is extracted by a turbine to drive the engine compressor. In multi-stage turbine sections, stators are placed at the entrance and exit of the turbine section, as well as between each turbine stage, for purposes of properly directing the air flow to each successive turbine stage. As a result, the stators are able to enhance engine performance by appropriately influencing gas flow and pressure within the turbine section.

Stators generally consist of an annular array of airfoils, or vanes, which are supported by a pair of concentric annular bands, all of which are preferably cast from a suitable high temperature material, such as a single-crystal nickel-based superalloy. It is generally impractical to form stators from a single casting, particularly those for use in larger engines, due to metallurgical constraints imposed during the casting process, as well as excessive thermal stresses created by nonuniform temperature distributions within the engine. As a result, stators are typically formed in segments as stator vane assemblies consisting of one or more airfoils positioned between an inner and outer band member. These vane assemblies are then individually mounted to the engine casing to form an annular array of stator vane assemblies, which is then located within the turbine section of the engine so that the airfoils project radially between an adjacent pair of turbine stages.

Various approaches have been proposed for constructing the stator vane assemblies, the most common approaches being illustrated in FIGS. 1 and 2. FIG. 1 depicts a two-piece vane assembly 48 which consists of a pair of vane castings 40 which are brazed together. Each vane casting 40 includes an outer band member 42, an inner band member 44 and an airfoil 46. The vane castings 40 are preferably single crystal or directionally solidified castings so as to enhance mechanical properties at elevated temperatures.

A disadvantage to this vane assembly construction is that for large vane castings 40 there tends to be recrystallization during the casting process, thereby altering the grain structure of the vane casting 40, particularly at the airfoil-to-outer band interface. Recrystallization occurs as the metal volumetrically shrinks during cooling in a mold which is conventionally made of ceramic. As the casting cools, the airfoil 46 contracts in length such that the outer and inner bands 42 and 44 contract toward each other, while contraction within the ceramic mold occurs to a much lesser degree. As a result, the mold serves as a restraint, preventing the outer and inner bands 42 and 44 from contracting towards each other as they would otherwise. As a result of this phenomenon, the high cast-in stresses which are created within the airfoil-to-outer band transition region of the vane casting 40 causes recrystallization in those regions, which adversely effects the mechanical properties of the vane casting 40, particularly at engine operating temperatures.

The primary alternative to the construction method of FIG. 1 is illustrated in FIG. 2. This vane segment is a four-piece assembly 50 consisting of an outer band 52, and inner band 54 and two airfoils 56, each of which are individually cast. Both the outer and inner bands 52 and 54 are provided with slots or openings 58 into which the ends of the airfoils 56 can be brazed in place to form the vane assembly 50. An advantage with the use of this construction method is that cast-in stresses are substantially avoided, reducing the likelihood of recrystallization.

However, a disadvantage with this approach arises from the vane assembly 50 being generally attached to the engine casing at the outer band 52 only, with the airfoils 56 and inner band 54 being essentially cantilevered into the engine's air stream. Consequently, the highest mechanical stresses in the vane assembly 50 occur at the airfoil-to-outer band interface which, in this instance, is a braze joint whose strength is inferior to that of an integrally cast interface. In this regard, the integrally cast construction of the vane assembly illustrated in FIG. 1 is superior.

From the above, it can be seen that vane assemblies taught by the prior art are generally either subject to recrystallization during the casting process, which is detrimental to the vane assembly's high temperature properties, or is subject to fatigue cracking and fracture as a result of mechanical stresses being concentrated at a braze joint.

Accordingly, it would be advantageous to provide an improved stator vane assembly whose construction overcomes the disadvantages of the prior art. Specifically, it would be desirable to provide a stator vane assembly composed of single crystal or directionally solidified cast components which are less prone to recrystallization during the casting process, and whose construction avoids maximum stress concentrations at braze joints between the cast components.

SUMMARY OF THE INVENTION

It is therefore an object of this invention to provide an improved stator vane assembly for use between turbine stages of a gas turbine engine.

It is a further object of this invention that such a stator vane assembly be composed of single crystal or directionally solidified castings whose individual geometries substantially reduce the tendency for the castings to recrystallize during the casting process.

It is yet another object of this invention that such a stator vane assembly be assembled so that the highest mechanical stresses tend to occur within the castings and not at joints between the castings.

In accordance with a preferred embodiment of this invention, these and other objects and advantages are accomplished as follows.

According to the present invention, there is provided a stator vane assembly which includes at least one vane casting and an inner band member. The vane casting includes both an outer band member and an airfoil member which is integrally cast with the outer band member, such that a continuous cast interface region is provided between the outer band member and the airfoil member. The airfoil member is substantially normal to the outer band member, with the inner band member being secured to the end of the airfoil member opposite the outer band member, so as to complete the vane assembly.

When mounted to the engine casing, the stator vane assembly is oriented such that the airfoil member extends radially inward from the outer band member toward the central axis of the engine. When the required number of stator vane assemblies are mounted within the turbine section of a gas turbine, they define a turbine nozzle vane assembly consisting of an annular array of radially extending stator vanes. The outer and inner band members of the stator vane assemblies define radially outward and inward flowpath boundaries, respectively, for the combustion gases moving through the engine.

An advantage of the present invention is that, as a result of the integral cast construction of the outer band member with the airfoil member, the stator vane assembly is more readily able to withstand the high mechanical stresses which are imposed on the stator vane assembly during the operation of the gas turbine engine, in that the maximum mechanical stresses will occur at the continuous cast interface region between the outer band member and the airfoil member.

Furthermore, because the inner band member is cast separately from the vane casting composed of the airfoil and outer band members, the tendency for the cast components of the stator vane assembly to recrystallize during the casting process is significantly reduced. Specifically, the cast-in stresses associated with an integrally cast vane assembly are avoided in that the inner and outer band members are not cast together within the same casting mold. Therefore, shrinkage of the casting as it cools does not create tensile stresses within the airfoil, which would promote recrystallization of the casting, particularly the airfoil-to-band transition region.

Another advantage of this invention is the ability for the stator vane assembly to be assembled using known joining methods, such as brazing, riveting, welding or staking, such that conventional fabrication and assembly processes can be used to secure the inner band member to the airfoil member.

Other objects and advantages of this invention will be better appreciated from the following detailed description.

DETAILED DESCRIPTION OF THE INVENTION

The present invention provides an improved stator vane assembly for use in gas turbine engines, wherein the stator vane assembly is constructed in a manner which promotes the ability of the stator vane assembly to withstand mechanical stresses imposed during engine operation, as well as reduces the tendency for the cast components of the stator vane assembly to recrystallize during the casting process, such that the metallurgical integrity of the stator vane assembly is preserved. As a result, the stator vane assembly is better able to structurally withstand the severe operating conditions within the turbine section of a gas turbine engine.

Figure 3:
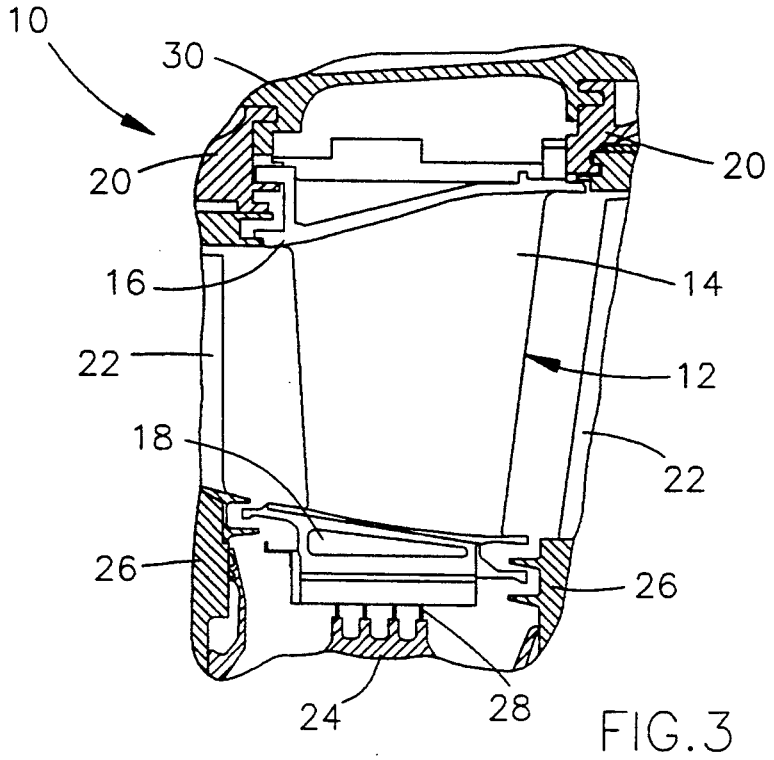
FIG. 3 is a partial side view of a turbine section of a gas turbine engine.
Figure 4:
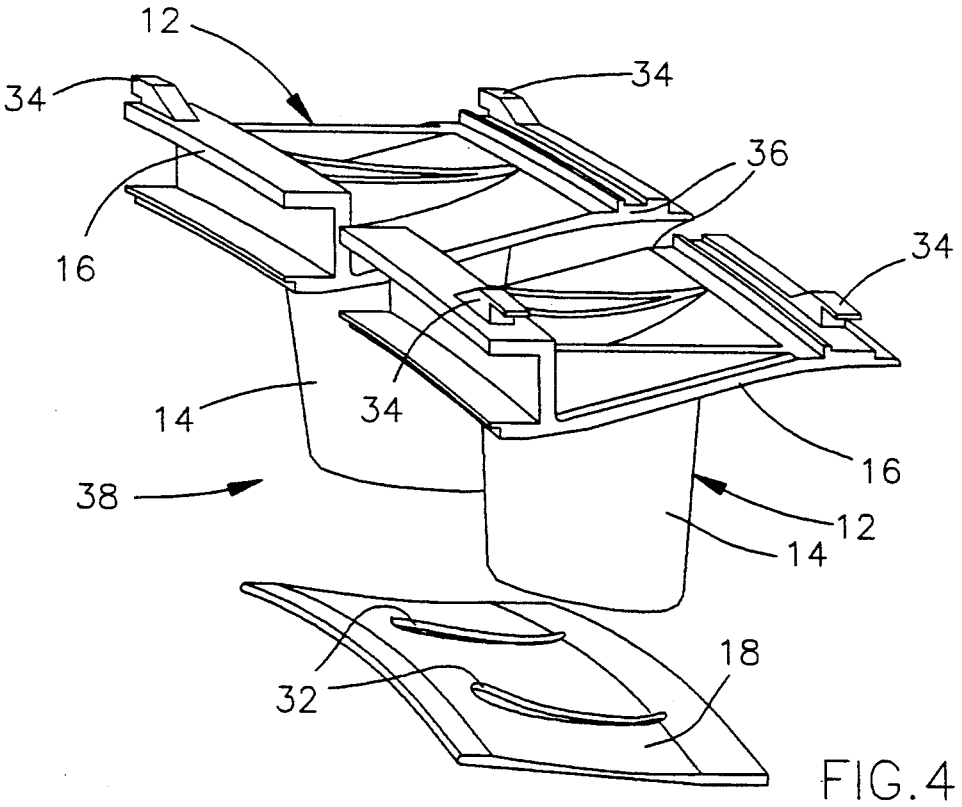
FIG. 4 is an exploded view of a stator vane assembly in accordance with a preferred embodiment of this invention.

A stator vane assembly 38 in accordance with the present invention is shown in FIGS. 3 and 4. The stator vane assembly 38 includes an inner band member 18 and a pair of vane castings 12, each of which is composed of an airfoil member 14 and an outer band member 16. As best seen in FIG. 3, the stator vane assembly 38 is adapted for use in a conventional turbine nozzle section 10 of a gas turbine engine. The outer band members 16 are provided with support features 34 by which the stator vane assembly 38 can be supported with a pair of hangers 20 which, in turn, are supported by the engine casing 30.

As is conventional, the stator vane assembly 38 is located between adjacent turbines blades 22 mounted to axial spaced disks 26. The airfoil members 14 are oriented so as to appropriately direct the flow of combustion gases between each turbine stage in a manner which will enhance engine performance. As is also conventional, an axial spacer 24 is disposed between each pair of adjacent disks 26. The axial spacer 24 supports a number of seals 28 which are in sliding contact with the radially inward surface of the inner band member 18. The seals 28 serve to force the combustion gases flowing through the turbine nozzle section 10 to pass between the airfoil members 14 of the stator vane assembly 38.

In accordance with the preferred embodiment of this invention, the stator vane assembly 38 is a three-piece construction, in contrast to the two and four-piece constructions taught by the prior art. Specifically, the stator vane assembly 38 is composed of two vane castings 12 and the inner band member 18. The vane castings 12 are each an integral casting which forms the airfoil member 14 and the outer band member 16 of the stator vane assembly 38, such that a continuous cast interface region exists between the airfoil member 14 and the outer band member 16. Most preferably, the vane castings 12 are formed from a suitable high temperature material, such as an appropriate nickel-based superalloy of the type known in the art, and are cast as single crystal or directionally solidified castings to promote the high temperature properties of the castings.

The inner band member 18 is also preferably cast from a high temperature material, such as the preferred nickel-based superalloy. The inner band member 18 is provided with a pair of slots or openings 32 which, as shown, correspond in size and shape to the cross section of the airfoil members 14. When assembled, each of the airfoil members 14 is inserted in a corresponding one of the openings 32, such that the airfoil members 14 are substantially parallel to each other and such that mating surfaces 36 on the outer band members 16 abut each other. The individual components of the stator vane assembly 38 are then permanently joined to each other, preferably by brazing the airfoil members 14 within their corresponding openings 32 in the inner band member 18 and brazing the outer band members 16 together at their corresponding mating surfaces 36. Suitable brazing techniques can be accomplished using conventional equipment and processes, and are well known to those skilled in the art. Alternatively, the cast components may be joined by riveting, welding or staking in accordance with methods well known in the art.

The stator vane assembly 38 can then be secured within the turbine nozzle section 10 of a gas turbine engine by engaging each support feature 34 with the appropriate hanger 20, as shown in FIG. 3. When properly supported by the engine casing 30, the stator vane assembly 38 is oriented such that the airfoil member 14 extends radially inward from the outer band member 16. When the required number of stator vane assemblies 38 are mounted within the turbine section 10 of a gas turbine, they define a turbine nozzle vane assembly consisting of an annular array of stator vanes which extend radially between an adjacent pair of turbine stages.

Figure 2:
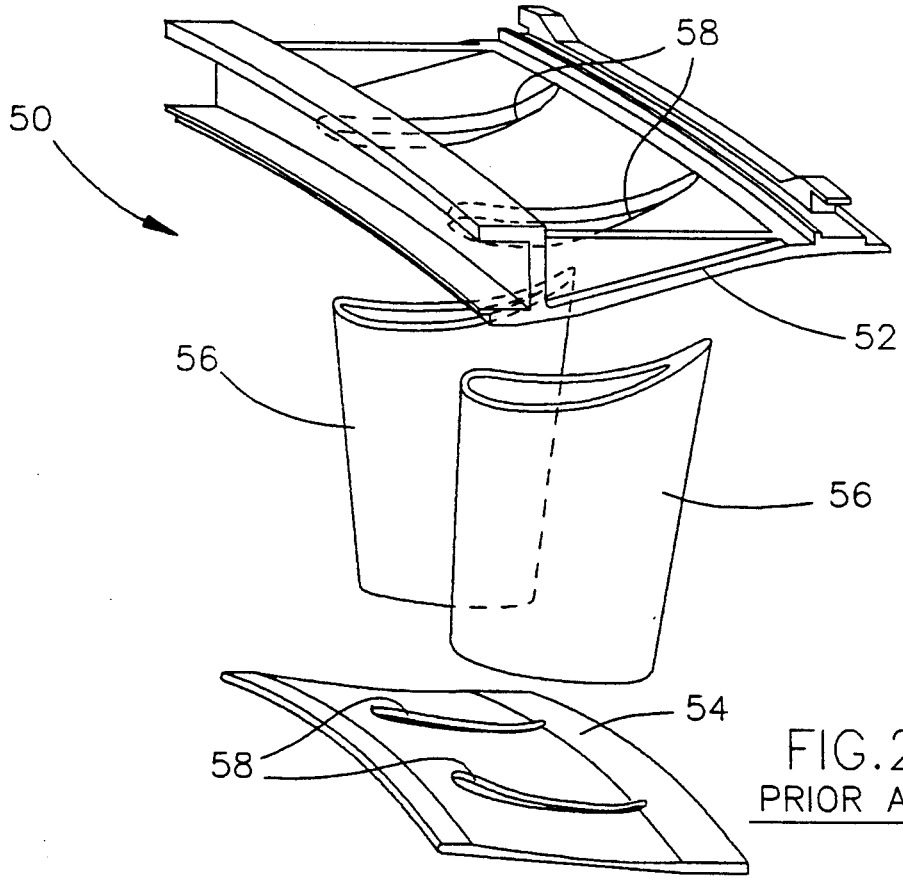
FIG. 2 PRIOR ART
FIG. 2 is an exploded view of a second stator vane assembly of the type known in the prior art.

From the above, it can be seen that an advantage of the present invention is that the integral cast construction of the outer band member 16 with the airfoil member 14 enables the stator vane assembly 38 to more readily withstand the high mechanical stresses which are induced during the operation of the gas turbine engine. Specifically, the maximum mechanical stresses within the stator vane assembly 38 will occur at the continuous cast interface region between the outer band member 16 and the airfoil member 14, as a result of the airfoil member 14 and inner band member 18 being cantilevered into the turbine nozzle section 10. This cast interface region is much more capable of enduring the mechanical stresses imposed than are the brazed joints of the conventional four-piece construction illustrated in FIG. 2.

Figure 1:
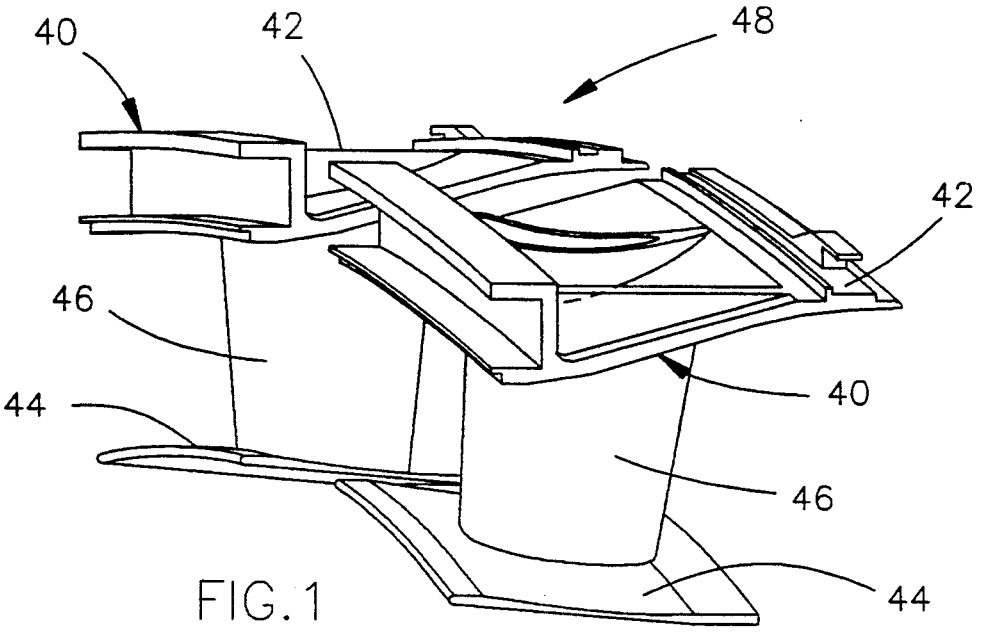
FIG. 1 PRIOR ART
FIG. 1 is an exploded view of a first stator vane assembly of the type known in the prior art.

Another significant advantage of this invention is that the inner band member 18 is separately cast from the vane casting 12. As a result, substantially no tensile loading is induced within the airfoil member 14 as the vane casting 12 cools, such that cast-in stresses within the region of the airfoil-to-outer band interface are substantially prevented. Consequently, this cause of recrystallization within the cast components of the stator vane assembly 38 is substantially eliminated. Specifically, the cast-in stresses associated with an integrally cast vane assembly of the two-piece construction shown in FIG. 1 are avoided, in that the outer and inner band members 16 and 18 are not cast together within the same casting mold.

Another advantage of this invention is the ability for the stator vane assembly 38 to be assembled using conventional joining methods. Specifically, conventional brazing techniques can be used to join the vane castings 12 to the inner band members 16, as well as to join the mating surfaces 36 of the outer band members 16. As a result, substantially conventional fabrication and assembly methods can be employed to produce the stator vane assembly 38 of this invention, such that the stator vane assembly 38 is comparable in cost to vane assemblies presently known. Those skilled in the art will also recognize that the present invention is also applicable to stator vanes cast from other brazable materials other than the preferred nickel-based superalloy.

Accordingly, while our invention has been described in terms of a preferred embodiment, it is apparent that other forms could be adopted by one skilled in the art. Therefore, the scope of our invention is to be limited only by the following claims.

The embodiments of the invention in which an exclusive property or privilege is claimed are defined as follows:

1. A vane assembly for a gas turbine engine, the vane assembly comprising:

a vane casting having an outer band portion and an airfoil portion integrally cast with the outer band portion so as to form a continuous cast interface region between the outer band portion and the airfoil portion, the airfoil portion projecting from the outer band portion; and an inner band member secured to the airfoil portion so as to form the vane assembly;

whereby the integral cast construction of the outer band portion and the airfoil portion promotes the ability of the vane assembly to withstand high stresses induced at the continuous cast interface region between the outer band portion and the airfoil portion during operation of the gas turbine engine, and whereby cast-in stresses are substantially reduced in the vane assembly as a result of the inner band member being formed separately from the vane casting.

2. A vane assembly as recited in claim 1 wherein the inner band member is brazed to the airfoil portion.

3. A vane assembly as recited in claim 1 wherein the inner band member has an opening formed therein, the airfoil portion being secured within the opening in the inner band member.

4. A vane assembly as recited in claim 1 wherein the vane assembly comprises at least two vane castings, each vane casting having an outer band portion which is integrally cast with a corresponding airfoil portion, the inner band member having openings for receiving each of the corresponding airfoil portions.

5. A vane assembly as recited in claim 4 wherein the outer band portions are secured together.

6. A vane assembly as recited in claim 1 wherein a plurality of the vane assemblies are secured within the gas turbine engine to form an annular-shaped turbine nozzle vane assembly.

7. A vane assembly as recited in claim 1 further comprising means formed on the outer band portion for supporting the vane assembly within the gas turbine engine.

8. A vane assembly as recited in claim 1 wherein the vane assembly is a stator vane assembly.

9. A vane assembly as recited in claim 1 wherein the vane assembly is a turbine nozzle stator vane assembly.

10. A stator vane assembly for a gas turbine engine, the stator vane assembly comprising:

at least two vane castings, each of the vane castings including an outer band portion and an airfoil portion integrally cast with the outer band portion so as to form a continuous cast interface region between the outer band portion and the airfoil portion, the outer band portions being secured together such that each of the airfoil portions projects from their corresponding outer band portion and terminates at a distal ends; and an inner band member secured to the distal end of each of the airfoil portions so as to form the stator vane assembly;

whereby the integral cast construction of the vane castings promotes the ability of the stator vane assembly to withstand high stresses induced at the continuous cast interface region between the outer band portion and the airfoil portion during operation of the gas turbine engine, and whereby cast-in stresses are substantially reduced in the vane castings as a result of the inner band member being formed separately from the vane castings.

11. A stator vane assembly as recited in claim 10 wherein the inner band member is brazed to each of the distal ends of the airfoil portions.

12. A stator vane assembly as recited in claim 10 wherein the inner band member has openings formed therein, the distal end of each of the airfoil portions being received in a corresponding one of the openings in the inner band member.

13. A stator vane assembly as recited in claim 10 wherein a plurality of the stator vane assemblies are secured within the gas turbine engine to form an annular-shaped turbine nozzle stator vane assembly, wherein each outer band portion is supported within the gas turbine engine so as to be circumferentially adjacent to other outer band portions, such that each inner band member is circumferentially adjacent to other inner band members and such that the airfoil portions define an annular array of radially extending stator vanes.

14. A stator vane assembly as recited in claim 10 further comprising means formed on the outer band portions for supporting the stator vane assembly within the gas turbine engine.

15. A stator vane assembly as recited in claim 10 wherein the vane castings and the inner band member are each cast from a single-crystal nickel-based superalloy.

16. A turbine nozzle stator vane assembly for a gas turbine engine, the turbine nozzle stator vane assembly comprising:

a plurality of three-piece vane assemblies supported within the gas turbine engine such that the turbine nozzle stator vane assembly has an annular shape, each vane assembly comprising:

two vane castings, each of the vane castings having an outer band portion and an airfoil portion integrally cast with the outer band portion so as to form a continuous cast interface region between the outer band portion and the airfoil portion, the outer band portions being brazed together such that the airfoil portions extend radially inward from their corresponding outer band portion and terminate at radially inward ends; and an inner band member brazed to the radially inward end of each of the airfoil portions so as to form the vane assembly, the inner band member having two openings formed therein for receiving the radially inward ends of the airfoil portions;

whereby the integral cast construction of each vane casting promotes the ability of the vane assemblies to withstand high stresses induced at the continuous cast interface region between the outer band portion and the airfoil portion during operation of the gas turbine engine, and whereby cast-in stresses are substantially reduced in the vane castings as a result of the inner band member being formed separately from the vane castings;

wherein each vane assembly is supported within the gas turbine engine such that each outer band portion is circumferentially adjacent to other outer band portions, each inner band member is circumferentially adjacent to other inner band members, and the airfoil portions define an annular array of radially extending stator vanes.

17. A turbine nozzle stator vane assembly as recited in claim 16 further comprising means formed on the outer band portions for supporting the vane assemblies within the gas turbine engine.

18. A turbine nozzle stator vane assembly as recited in claim 16 wherein the vane castings and the inner band member are each cast from a single-crystal nickel-based superalloy.

* * * * *